United States Patent [19]

Traffanstedt et al.

[11] Patent Number: 4,705,935

[45] Date of Patent: Nov. 10, 1987

[54] HEATED SOCKS

[76] Inventors: Albert J. Traffanstedt, Rte. 8, Box 221, Boaz, Ala. 35957; Roy Traffanstedt, 615 Half Section Line Rd., Apt. 107, Albertville, Ala. 35950

[21] Appl. No.: 767,494

[22] Filed: Aug. 20, 1985

[51] Int. Cl.[4] ..... H05B 1/02

[52] U.S. Cl. ..... 219/211; 219/486; 219/529

[58] Field of Search ..... 219/211, 212, 486, 528, 219/529, 548, 549, 201, 200, 527; 429/82, 84, 163

[56] References Cited

U.S. PATENT DOCUMENTS

| | | | |
|---|---|---|---|
| 397,969 | 2/1889 | Cross | 429/82 |
| 1,757,889 | 5/1930 | Wheat | 429/163 |
| 2,298,298 | 10/1942 | Joy | 219/211 |
| 2,626,343 | 1/1953 | Fogel | 219/211 |
| 2,718,584 | 9/1955 | Hariu | 219/211 |
| 3,084,241 | 4/1963 | Carrona | 219/211 |
| 3,396,264 | 8/1968 | Murphy | 219/211 |
| 3,999,037 | 12/1976 | Metcalf | 219/211 |
| 4,042,803 | 8/1977 | Bickford | 219/211 |
| 4,279,255 | 7/1981 | Hoffman | 219/211 |
| 4,404,460 | 9/1983 | Kerr | 219/211 |

FOREIGN PATENT DOCUMENTS

| | | | |
|---|---|---|---|
| 492396 | 7/1919 | France | 429/84 |
| 18092 | of 1915 | United Kingdom | 429/84 |
| 587189 | 4/1947 | United Kingdom | 219/211 |

*Primary Examiner*—E. A. Goldberg
*Assistant Examiner*—Teresa J. Walberg
*Attorney, Agent, or Firm*—George J. Porter

[57] ABSTRACT

A heated sock (14 or 16 of FIG. 1) for keeping the wearer's foot warm in a cold environment and including a resistive heating unit (10 or 12) secured in two of the socks, a battery source (76 FIG. 2) having first (78) and second (80) terminals and which is carried on the wearer's body, and switches (36 and 64) controllable by the wearer for acting in combination with the resistive heating unit (10 or 12) to selectively cause different and controllable amounts of electric current from the battery source (76) to flow through the resistive heating unit (10 or 12) to thereby generate different and desired amounts of heat in the sock (14 or 16).

3 Claims, 7 Drawing Figures

HEATED SOCKS

TECHNICAL FIELD

This invention relates generally to electrically heated footware and more particularly to an improvement in electrically heated socks such as used by deer hunters, for example.

BACKGROUND OF THE INVENTION

There are, in the prior art, several forms of heated footware, often used by deer hunters and those engaged in other forms of cold weather activities, and mostly in the form of electrically heated shoes, but some in the form of electrically heated socks. Reference is made to U.S. Pat. No. 3,396,264 by Murphy et al, that discloses a sock which is electrically heated by a resistive heating element contained therein which extends across the toes of the wearer. A d.c. battery source held in a pouch secured around the weare's leg near the top of the sock is employed to supply the energy to heat the resistive element. The positive and negative poles of the battery are secured across opposite ends of the resistive heating element to supply a current through the resistive heating element which gradually decreases with usage, resulting in a gradual cooling of the resistive heating element.

Other U.S. Pat. No. 3,906,185 to Gross and U.S. Pat. No. 2,692,326 to Crowell show a shoe heated by a resistive element which is powered by a battery carried on the wearer's clothes. Both of these also disclose battery powered resistive elements in which the maximum battery voltage is always connected across the entire resistive heating element and, accordingly, will usually heat the heating elements to a higher than needed and perhaps uncomfortable temperature when the battery is fresh and fully charged and then, after an hour or two, when the user is tried and the cold has penetrated well into the shoes, the battery will be partially discharged and will not be able to heat the resistive heating elements to a foot comfortable temperature.

It would mark a definite improvement in the art to provide heated socks which would sustain a more nearly constant foot comfortable temperature over a longer period of time with a given battery source than has been heretofore possible.

It is a primary object of the invention to provide a pair of socks that are heated by a battery powered resistive heating unit which maintains the temperature of the resistive heating unit, and therefore of the socks and the feet, at a more nearly constant level for a longer period of time with a given battery source than has been obtainable heretofore.

Another object of the invention is to lengthen the effective, usable life of a fully charged battery while maintaining the temperature of a resistive heating element at a foot comfortable level.

A third object is to provide a person, such as a deer hunter, who spends prolonged periods of time on his feet in cold weather with a pair of heated socks which maintain a nearly constant foot comfortable temperature for a relatively long period of time.

BRIEF SUMMARY OF THE INVENTION

In one preferred form of the invention there is provided a pair of heatable socks for keeping the wearer's feet warm in a cold environment and comprising a resistive heating unit secured in the toe of each sock, a battery source having first and second terminals and which is carried on the wearer's body, and switching means controllable by the wearer for acting in combination with the resistive heating unit to selectively cause different and controllable amounts of electric current from the battery source to flow through the resistive heating units to thereby generate different and desired amounts of heat in the socks.

DETAILED DESCRIPTION OF THE INVENTION

Figure 1:
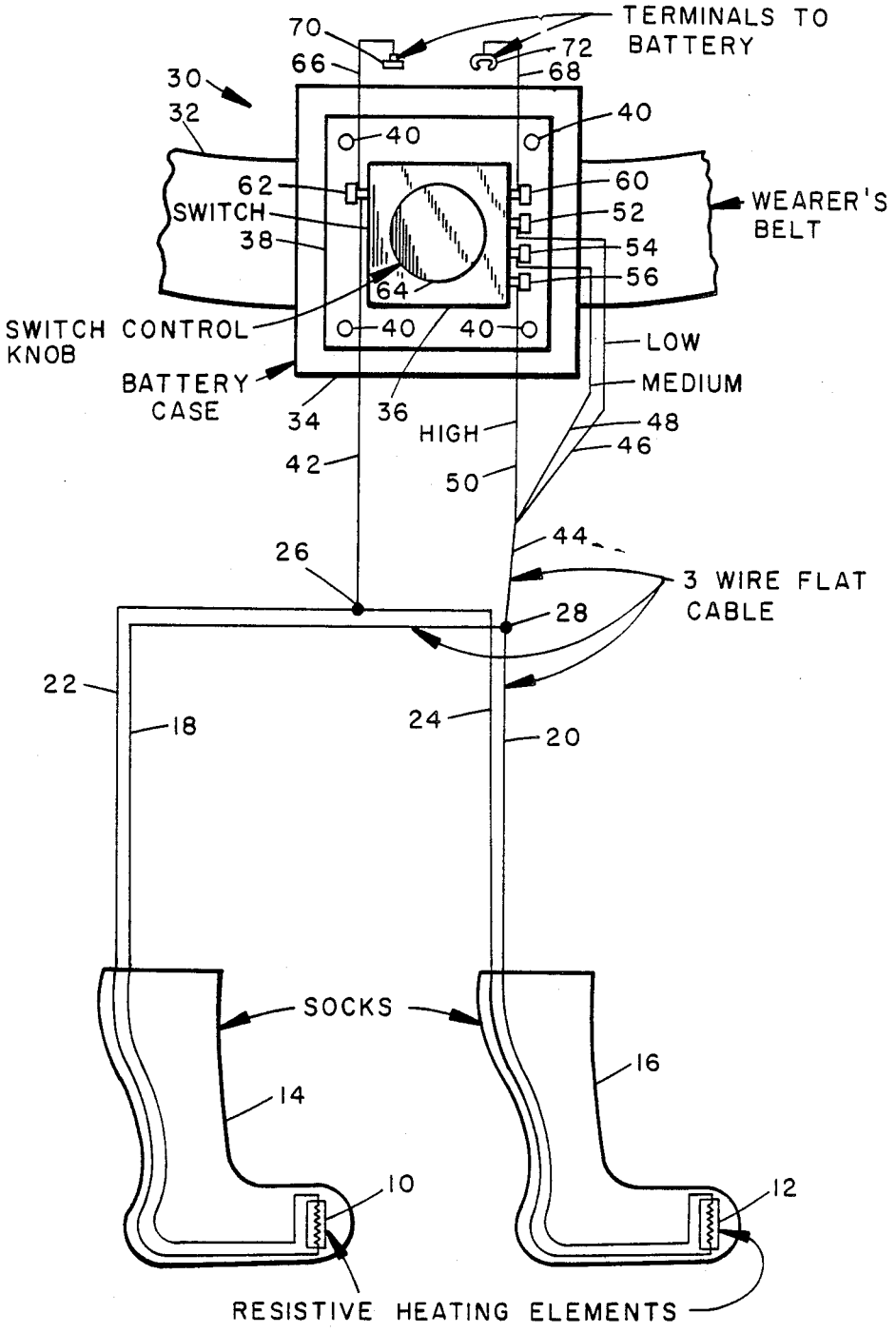
FIG. 1 shows an overall view of the invention including the socks, the resistive heating elements therein, the battery source case, the switch, and the general wiring therebetween.

Referring now to FIG. 1 a pair of resistive heating units (or elements) 10 and 12 are knitted, sewed, or otherwise secured to or within the socks 14 and 16 so as to extend across that portion of the sock which covers the toes of the wearer. It is important that the resistive elements not touch the skin of the wearer but be insulated therefrom by the thickness of the sock or a piece of heat diffusion material secured in the sock between the wearer's skin and the resistive heating element.

The resistive heating units 10 and 12 are connected at one end through wires 22 and 24 to a junction 26 from whence they continue as a single wire 42 to terminal 62 of switch 36 which in turn is connected to the negative terminal 80 of battery 76 (see FIG. 2) via lead 66 and terminal connector 70 of FIG. 1.

The other conductors 18 and 20 connected to resistive heating elements 10 and 12 can be 3-wire flat cables in the circuits of the embodiments of the invention of FIGS. 5 and 6 and single wires in the circuit embodiment of FIG. 7, as will be discussed in detail later herein.

Corresponding pairs of the three individual wires of each of the two 3-wire flat cables 18 and 20 are connected together at junctions as shown in more detail in FIGS. 5 and 6, and continue as a single 3-wire flat cable 44 to the three switch terminals 52, 54, and 56 which represent low, medium, and high temperature settings for the resistive heating units, as will also be discussed in more detail in connection with FIGS. 5 and 6.

Figure 7:
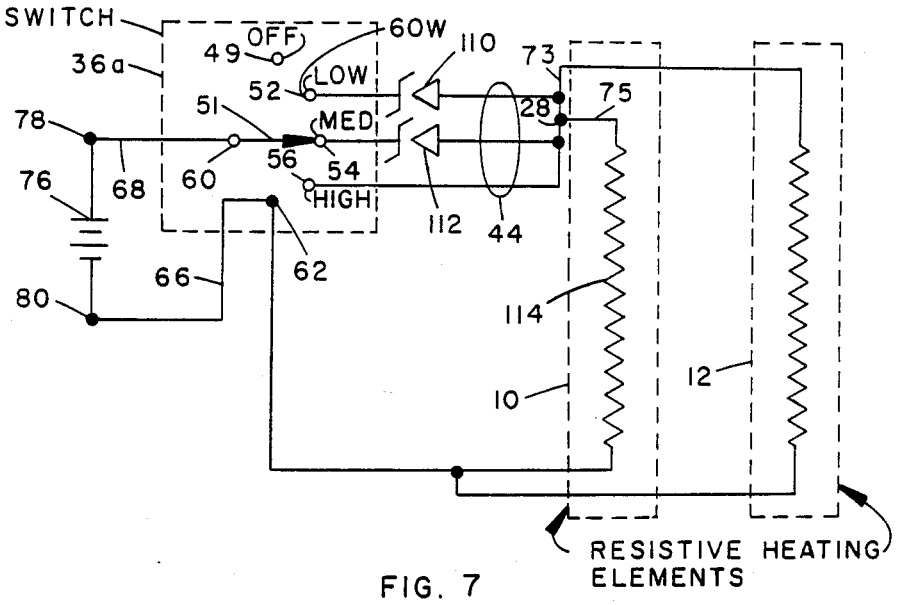
FIG. 7 shows a third form of the battery source, switch, and resistive heating unit.

In the circuit embodiment of FIG. 7, the conductors 18 and 20 are single wires which are connected at junction 28 to all three wires of the 3-wire flat cable 44, as shown in FIG. 7, and also to be discussed later herein. The three individual wires of the last mentioned 3-wire flat cable of FIG. 7 are also connected to the low, medium and high temperature setting terminals 52, 54, and 56 of switch 36 of FIG. 1.

Referring again to FIG. 1 the switch 36 is connected, as by rivets 40 or other suitable means, to battery holding case 34 by means of plate 38.

The connection of the positive terminal 78 of battery 76 (see FIG. 2), which is connected to terminal 60 of switch 36, and then through switch 36 to any of the three terminals 52, 54, and 56 on switch 36 is effected by turning switch control knob 64 to the correct position. It will be noted in FIGS. 5, 6, and 7 that switches 36 and switch 36*a* each have an off position 49 in which the battery 76 (FIG. 2) is disconnected from the resistive heating units 10 and 12 of FIG. 1.

The wearer's belt 32 of FIG. 1 fits through a belt loop 86 (see FIG. 2) secured to battery case 34 by suitable fastening means such as rivets 21.

Figure 2:
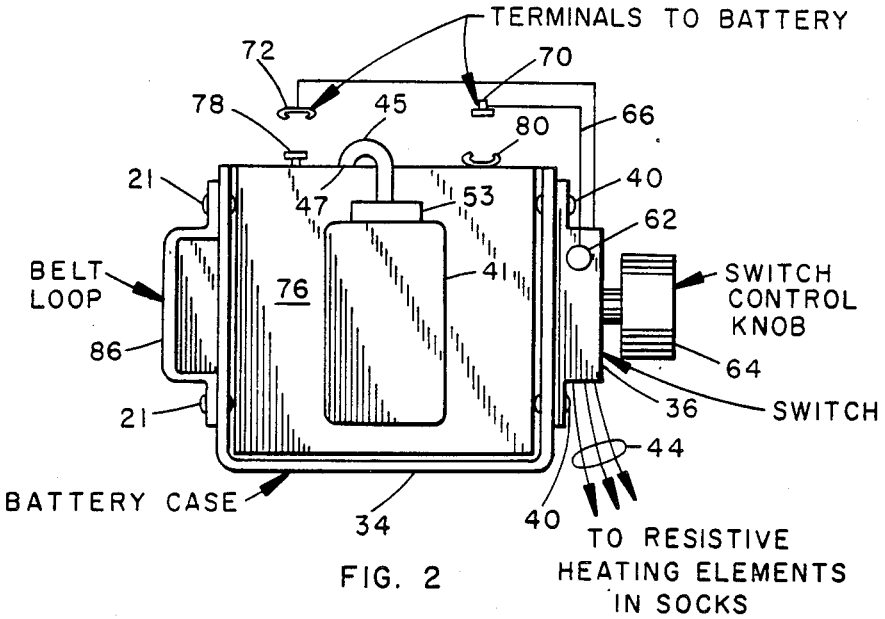
FIG. 2 shows a broken away side view of the battery source and case therefor, and the switch.

Referring now to FIG. 2 the battery 76 can be seen within the broken away side view of the battery holding case 34. The battery terminals 78 and 80, as well as the belt loop 86 can also be clearly seen in FIG. 2.

While other batteries, either dry or wet cell, can be used in the invention with very good results it has been found that a 6.3 volt, 3 cell wet battery manufactured by the Ztong Yee Industrial Co. Ltd. of Taiwan and identified as Model 6N2-2A-1 produces particularly excellent results, specifically in terms of long life and rechargibility as well as initial and maintenance costs.

Figure 3:
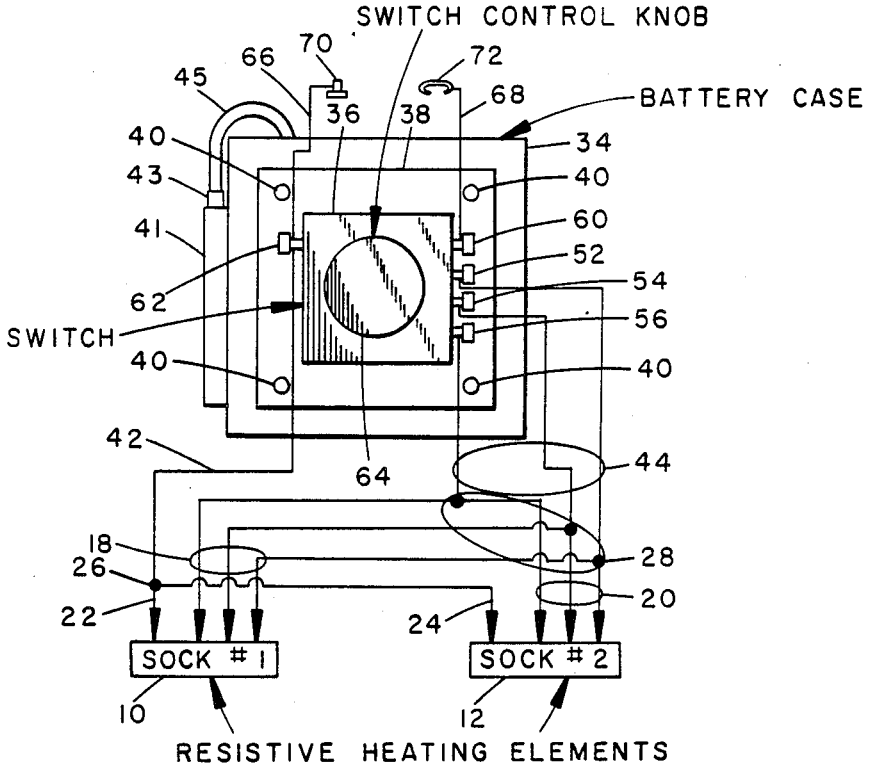
FIG. 3 shows a side view of the structure of FIG. 1.
Figure 4:
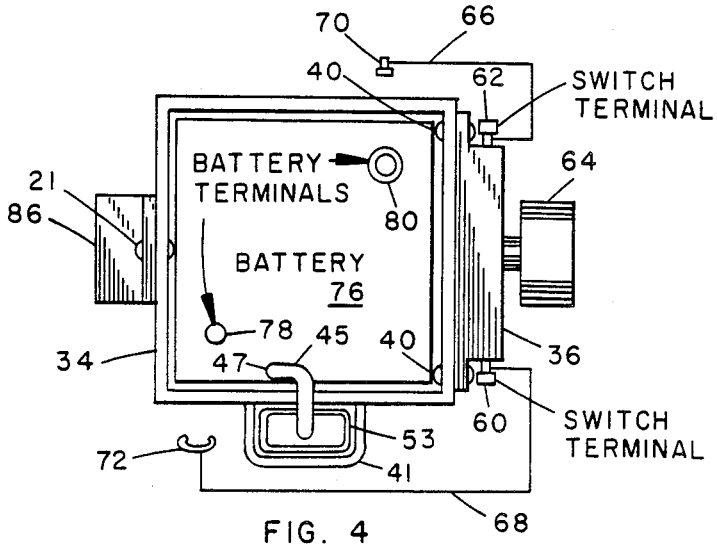
FIG. 4 shows a top view of the structure of FIG. 1.

When a wet cell battery is used toxic and corrosive gases are often generated which normally escape out through a vent 47 provided therefor in the battery, as shown in FIGS. 2 and 4. Sometimes an actual overflow of acid can escape through this vent 47. To prevent damage to the wearer and to his clothes a tube 45 (see FIGS. 2, 3 and 4) connects vent 47 to a container 53 attached to an appurtenance case 41 of battery case 34, as shown in FIGS. 2, 3, and 4. The container 53 can be removed from case 41 and emptied when needed.

FIG. 3 is a side view of the structure of FIG. 2 and more clearly shows the switch terminal 60 which is connected to the positive terminal 78 of battery 76 through wire 68 and connector 72, as well as the three switch terminals 52, 54, and 56 which connect the positive terminal 78 (FIG. 2) of the battery 76 through leads 44 to the resistive heating units 10 and 12 to create low, medium, and high temperature settings, respectively, of the resistive heating units 10 and 12.

Also shown in FIG. 3 is a more detailed diagram of the wiring of the invention. More specifically, it can be seen that the three wires of flat cable 44 each separate at junctions 28 into two wires, in a manner to form two 3-wire flat cables 18 and 20 which in turn go to resistive heating units 10 and 12, respectively. It should be specifically noted that 3-wire flat cables corresponding to the 3-wire flat cables 18 and 20 of FIG. 2 are employed only in the embodiments of the invention shown in FIGS. 5 and 6. The circuit of FIG. 7 requires only a single lead (73 and 75) going to each of the heating units 10 and 12. FIGS. 5, 6, and 7 will all be discussed in detail later herein.

Referring again to FIG. 3 it can be seen that the lead 42, which is connected to the negative pole 80 of battery 76 through switch terminal 62, lead 66, and connector 70, divides into two single wire leads 22 and 24 at junction 26 in FIG. 2, which go respectively to the heating units 10 and 12.

FIG. 4 is a top view of FIG. 2 and more clearly shows the terminals 78 and 80 of battery 76 and the manner in which battery 76 fits into case 34.

It is apparent that in all forms of this invention, wherever applicable, a 4-wire flat cable can be employed in lieu of a 3-wire flat cable so as to include the floating ground wires 22 and 24 (FIG. 1).

Figure 5:
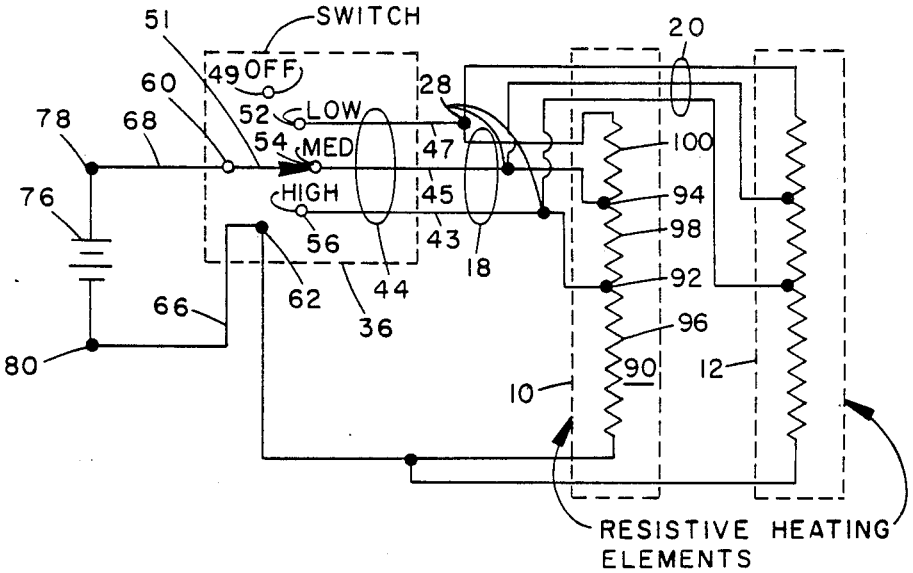
FIG. 5 shows a detailed circuit diagram of the battery source, the switch, and one form of the resistive heating unit.

Referring now to FIG. 5 there is shown a resistive heating unit and switching circuit arrangement whereby the low, medium, and high temperature settings are obtained by use of a tapped resistive heating element 90, which is tapped at points 92 and 94 to form three separate usable resistive values, e.g., resistor 96, a resistor consisting of resistors 96, 98, amd a resistor consisting of resistors 96, 98, and 100, or all of resistor 90.

It should be noted that the discussion of FIG. 5 will be directed only to resistive heating unit 10, and no discussion will be set forth with respect to resistive heating unit 12 since it is identical to that of resistive heating unit 10. The foregoing statement is also true of the discussions of FIG. 6 and 7, which will be set forth later herein.

Figure 6:
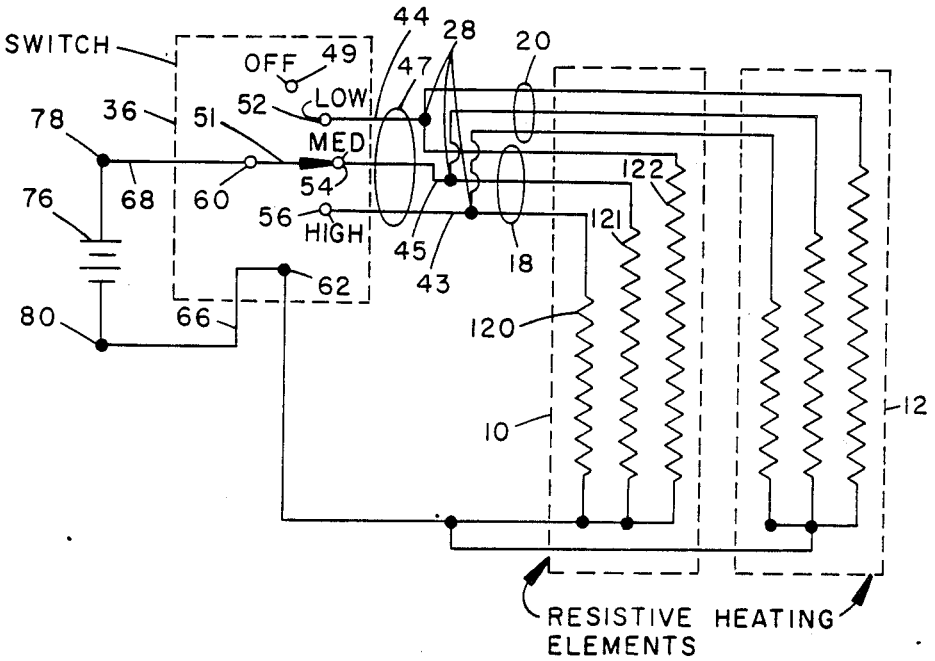
FIG. 6 shows another form of the battery source, switch, and resistive heating unit.

In all of FIGS. 5, 6, and 7 the armature 51 of the switches 36 and 36*a* is connected at its pivotal end to the positive terminal 78 of battery 76 through switch terminal 60 and lead 68 and at its contact end is selectively connectable to the OFF position contact 49, the LOW temperature position contact 52, the MEDIUM temperature position contact 54, or to the HIGH temperature position contact 56.

In FIGS. 5 and 6 the three temperature position contacts 52, 54, and 56 are connected respectively to leads 47, 45, and 43 which form 3-wire flat cable 44 which, as discussed above, forms 3-wire flat cables 18 and 20 and which in turn are connected to resistive heating units 10 and 12.

In FIG. 5 specifically, when arm 51 makes with LOW temperature setting contact 52 the battery 76 is connected across the entire resistor 90 so that the current flow therethrough is at its lowest value since I=E/R. Therefore, since power (or heat generated) is equal to $RI^2$ the amount of heat and therefore the temperature of resistive element 90 is at its lowest of any possible setting (except the OFF position).

When arm 51 makes with MEDIUM temperature setting contact 54, battery source 76 is connected only across portions 98 and 96 of resistor 90, which has smaller resistive value than all of resistor 90.

In the discussion of temperature settings the following relationships are relevant.

$$RI=E \quad \text{(Exp. 1)}$$

$$I=E/R \quad \text{(Exp. 2)}$$

$$P(\text{wattage})=EI \quad \text{(Exp. 3)}$$

$$\text{Since } RI=E \therefore P=RI^2 \quad \text{(Exp. 4)}$$

$$\text{and since } I=E/R \therefore P=E^2/R \quad \text{(Exp. 5)}$$

$$\text{so that } RI^2=E^2/R \quad \text{(Exp. 6)}$$

where

I=Current

E=Voltage

R=Resistance

P=Wattage

Therefore, since I=E/R (Exp. 2) and since heat is proportional to power (wattage) which is equal to $RI^2$ (Exp. 4) and since current I increases as R decreases and further, since the heat generated increases as the square of I and only directly porportional to R, it follows that more heat is generated when the battery 76 is connected across a smaller resistor (portions 96 and 98 of resistor 90) than when connected across the entire, larger resistor 90.

Similar logic will show that the heat generated in portion 96 of resistor 90 produces the highest temperature in the resistive heating element 10.

The circuit of FIG. 6 has similarities to that of FIG. 5. However, in FIG. 6 three separate resistors 120, 121, and 122 are employed with the following value relationship:

$$R120 < R121 < R122 \qquad \text{(Exp. 7)}$$

Consequently, when arm 51 makes with LOW contact 52 the least amount of heat will be generated in resistive heating unit 10. When arm 51 makes with MEDIUM contact 54, more heat will be generated since R121<R122. For the same reason, when arm 51 makes with HIGH contact 56 the greatest amount of heat will be generated in resistive heating unit 10 since R120<R121.

Referring now to FIG. 7 the LOW and MEDIUM setting contacts 52 and 54 are connected to the cathodes of Zener type diodes 110 and 112 respectively. The Zener diodes 110 and 112 have different breakdown voltages with diode 110 having a larger breakdown voltage than diode 112. It is a characteristic of a Zener diode that once the breakdown voltage is reached the current through the diode can rise to high levels since the resistance of the diode, after the voltage breakdown threshold is reached, becomes very low. However, the breakdown voltage is maintained across the Zener diode. Consequently, the voltage across the resistive heating element 10, for example, is decreased by the amount of the Zener diode breakdown voltage. There is only a negligible power loss across the Zener diode.

Since the voltage across the resistor 114 in the heating unit 10 is reduced the current therethrough is reduced by virtue of Exp. 2 and the wattage dissipated as heat in resistor 114 is also reduced, as indicated in Exp. 3.

Since Zener diode 110 is selected to have a greater breakdown voltage than Zener diode 112, the amount of heat generated when arm 51 makes with contact 54 is greater than when it makes with contact 54, and the amount of heat generated is less than when arm 51 makes with contact 56 and connects battery 76 directly across resistor 114 rather than through a voltage reducing Zener diode.

Zener type diode arrangements, other than the one shown in FIG. 6, can also be utilized. These other Zener diode type voltage regulator arrangements are well known in the art and are intended to be included within the scope of the appended claims. More specifically, many of the various voltage regulator circuits shown and described on pages 12, 14, 60, 61, 392, 476, 478, 514, 543–547, 549, 551–552, 559, 590 and 596 of a book entitled "ELECTRONICS: THEORY, CIRCUITS AND DEVICES" by Roddy and Coolen and published in 1982 by Reston Publishing Co., Inc. of Reston, Va., a Prentice Hall Co., and on pages 80, 81, and 121 of a book entitled "THE RADIO AMATEUR'S HANDBOOK" published in 1977 by the Headquarter's Staff of the American Radio Relay League, both cited publications being incorporated herein by reference, can be utilized as voltage regulators in the circuit of FIG. 7 in lieu of the one actually shown in FIG. 7.

For example, the circuit of FIG. 14-2 on page 543 of the Roddy-Coolen book can be used where a current limiting resistor R is placed in series with the heater load resistor R and a Zener diode is connected in parallel with R. Separate ones of these circuits arranged in parallel can be utilized for the high and medium temperature settings in the present invention.

As another example, as shown in FIG. 5-22 on page 121 of the aforementioned Radio Handbook, a current limiting resistor can be connected in series with one or more Zener diodes and this arrangement connected in parallel with a load resistor R to produce a regulated (reduced) voltage across R.

It is to be noted that the forms of the invention shown and described herein are but some preferred embodiments thereof and that other circuit arrangements which might occur to one of ordinary skill are intended to be included within the scope of the appended claims.

We claim:

1. A pair of heatable socks comprising:

a resistive heating unit secured within each sock of said pair of socks and having a given floating ground terminal;

a portable battery source having first and second terminals with said first terminal being a floating ground terminal;

a switching means having first and second terminals connected across said first and second terminals of said portable battery source, respectively, a plurality of output contacts, and an arm for connecting any selected output contact to said second battery terminal;

circuit means for connecting said given floating ground terminal of each of said resistive heating units to said first terminal of said switching means and for connecting different ones of said output contacts to said resistive heating units to produce equal but selectively different current values through each of said resistive heating units;

each of said resistive units comprising a resistor having a given resistive value and having first and second end terminals; and in which said switching means comprises N output contacts, and further comprising:

a Zener diode connected between each of N−1 of said plurality of switching means output contacts and the second terminal of said resistor, and with the remaining switching means output contact being connected directly to said second end terminal of said resistors;

each of said Zener diodes being selected to have a breakdown voltage different from that of any other selected Zener diode; and in which said switching means is controllable to connect the second terminal of said battery source to any selected one of said switching means contacts to control the amount of current flowing through said resistors.

2. A pair of heatable socks for keeping the wearer's feet warm in a cold environment and comprising:

a resistive heating unit secured in each sock and having first and second end terminals;

a battery source having first and second terminals and which is carried on the wearer's body;

switching means controllable by said wearer for acting in combination with said resistive heating units to selectively cause different and controllable amounts of electric current from said battery source to flow through said resistive heating units to thereby generate different and desired amounts of heat in said socks;

said switching means comprising N output contacts, and further comprising:

a Zener diode connected between each of N−1 of said plurality of switching means output contacts and the first terminal of each of said resistive heating units and with the remaining switching means output contact connecting the first terminal of said battery source to said second end terminal of each of said resistive heating units;

each of said Zener diodes being selected to have a breakdown voltage different from that of any other selected Zener diode; and in which said switching means is controllable to connect the second terminal of said battery source to any selected one of said N−1 switching means output contacts to control the amount of current flowing through said resistive heating units.

3. A pair of heatable socks comprising:

a resistive heating unit secured within each sock of said pair of socks and comprising first and second end terminals;

a battery source having first and second terminals; and switching means connected across the first and second terminals of said battery source for controlling the amount of current flowing from said battery source through said resistive heating units and in which said switching means comprises N output contacts, and further comprising:

a Zener diode connected between each of N−1 of said plurality of switching means output contacts and the first end terminal of each of said resistive heating units;

with the remaining switching means output contact being connected directly to said second end terminal of said resistive heating units;

each of said Zener diodes being selected to have a breakdown voltage different from that of any other selected Zener diode; and in which said switching means is controllable to connect a selected one of the first or second terminals of said battery source through said switching means to any selected one of said N−1 switching means output contacts to control the amount of current flowing through said resistive heating units.

* * * * *